US009617951B2

(12) United States Patent
Sotiriades et al.

(10) Patent No.: US 9,617,951 B2
(45) Date of Patent: Apr. 11, 2017

(54) AIR FLOW GUIDE FOR AN INTERNAL COMBUSTION ENGINE

(71) Applicant: Champion Engine Technology, LLC, Sussex, WI (US)

(72) Inventors: Aleko D. Sotiriades, Cedarburg, WI (US); Russell J. Dopke, Elkhart Lake, WI (US)

(73) Assignee: Champion Engine Technology, LLC, Sussex, WI (US)

( * ) Notice: Subject to any disclaimer, the term of this patent is extended or adjusted under 35 U.S.C. 154(b) by 297 days.

(21) Appl. No.: 14/270,404

(22) Filed: May 6, 2014

(65) Prior Publication Data

US 2015/0322843 A1 Nov. 12, 2015

(51) Int. Cl.

| | |
|---|---|
| ***F01P 1/02*** | (2006.01) |
| ***F02F 1/34*** | (2006.01) |
| *F02B 63/04* | (2006.01) |

(52) U.S. Cl.

CPC *F02F 1/34* (2013.01); *F01P 1/02* (2013.01); *F01P 2001/023* (2013.01); *F02B 63/048* (2013.01)

(58) Field of Classification Search

CPC ..... F01P 1/02; F01P 1/026; F01P 1/06; F01P 7/00; F01P 7/02; F01P 2001/023; F02F 1/34; F02F 1/28; F02F 1/30

USPC ..... 123/41.58, 41.56, 41.69, 41.7, 41.31

See application file for complete search history.

(56) References Cited

U.S. PATENT DOCUMENTS

| | | | | |
|---|---|---|---|---|
| 2,700,377 | A | 1/1955 | Chesnutt | |
| 3,650,250 | A * | 3/1972 | Lohr | F02F 1/32 123/41.31 |
| 4,982,705 | A * | 1/1991 | Hudson | F01P 5/06 123/41.65 |
| 5,775,450 | A * | 7/1998 | Porter | B60K 11/02 180/68.1 |
| 6,314,922 | B1 * | 11/2001 | Zimmermann | B25F 5/008 123/41.56 |
| 7,191,753 | B2 * | 3/2007 | Sagara | F01P 1/02 123/198 E |
| 7,341,027 | B2 * | 3/2008 | Sugiyama | F02B 63/02 123/41.65 |
| 7,406,958 | B2 * | 8/2008 | Kanbara | F01P 11/12 123/41.7 |
| 7,451,843 | B2 * | 11/2008 | Nakashima | B60K 11/08 180/68.1 |
| 7,694,655 | B2 * | 4/2010 | Sagara | F01P 1/02 123/41.67 |

(Continued)

*Primary Examiner* — Grant Moubry

(74) *Attorney, Agent, or Firm* — Ziolkowski Patent Solutions Group, SC

(57) ABSTRACT

An air flow guide/diverter is disclosed for mounting to a cylinder head of an internal combustion engine. The air diverter directs cooling air to multiple locations on the cylinder head. The air diverter includes a main diverter shield having a proximal end extending from a cooling source to a distal end extending to the rear of the internal combustion engine. The air diverter includes a first arcuate member attached to the main diverter shield between the proximal end and the distal end of the main diverter shield, and a second arcuate member connected to the main diverter shield near the distal end of the main diverter shield. The air flow guide creates multiple channels of air to provide more efficient cooling with little added cost.

15 Claims, 10 Drawing Sheets

(56) References Cited

U.S. PATENT DOCUMENTS

| | | | | |
|---|---|---|---|---|
| 7,866,285 | B2 * | 1/2011 | DuQuette | F01P 1/02 123/41.56 |
| 7,958,855 | B2 * | 6/2011 | Nakamizo | F01P 5/06 123/41.65 |
| 7,980,205 | B2 * | 7/2011 | Sato | F01L 1/024 123/193.5 |
| 8,066,788 | B2 * | 11/2011 | Kobayashi | F01P 1/02 123/198 E |
| 8,210,133 | B2 * | 7/2012 | Hirose | F01P 5/06 123/198 E |
| 8,689,752 | B2 * | 4/2014 | Shimazaki | F01L 1/047 123/90.16 |
| 8,770,157 | B2 * | 7/2014 | Yano | F01P 1/02 123/41.27 |
| 8,899,191 | B2 * | 12/2014 | Yano | F02F 1/34 123/41.65 |
| 9,249,715 | B2 * | 2/2016 | Ichihashi | F01P 1/02 |
| 9,341,149 | B2 * | 5/2016 | Gille | F02B 29/0475 |
| 2012/0304948 | A1 * | 12/2012 | Schneiker | F02F 7/006 123/90.41 |
| 2013/0133597 | A1 | 5/2013 | Shimazaki et al. | |

* cited by examiner

AIR FLOW GUIDE FOR AN INTERNAL COMBUSTION ENGINE

BACKGROUND OF THE INVENTION

Embodiments of the invention relate generally to improved heat transfer from an air cooled internal combustion engine, and more particularly, to an apparatus to provide directional cooling to multiple locations on a single cylinder head.

Air cooled internal combustion engines utilize cooling fins located around the periphery of the cylinder block and head to transfer heat from the combustion process directly to the ambient environment. The fins act to increase surface area over which cooling air flows. Natural air flow may provide the cooling air or a fan and shroud may force cooling air across the fins.

While shrouds may provide cooling air from a fan in a general direction of the cylinder, many engines could benefit from more particularized airflow. For instance, a single shroud could supply air to both cylinders of a v-twin engine, but a generalized flow path may also provide air between the cylinders bypassing the cooling fins. Further, heat transfer may be increased if the cooling air is provided effectively to multiple locations on an individual cylinder. A cylinder head may contain non-uniform geometry requiring directed air flow while at the same time requiring cooling air at fins located around the periphery of the cylinder head.

In addition to cooling fins, other engine components may benefit from directional cooling and aid in dissipating heat from the cylinder. For instance, push rod tubes may be used in overhead valve (OHV) engines and can be located adjacent the cylinder. The push rod tubes provide a casing for push rods which operate intake and exhaust valves. As the push rod tubes heat up, they may dissipate significant heat from their surface if they are positioned in the stream of cooling air.

New enclosure designs for rocker components also have potential to dissipate significant heat from the cylinder head. Rocker covers often act as insulators as they encapsulate the cylinder head. Therefore, heat transfer could be improved if an enclosure increased conduction from the cylinder head and provided more surface area over which cooling air could be directed. Further, the enclosure could provide for cooling air to be directed over the hottest parts of the cylinder head.

Therefore, it would be desirable to provide a device to direct cooling air to multiple locations on an individual cylinder head. Further, it would be desirable to provide cooling air to push rod tubes on an overhead valve engine. It would be further advantageous if an enclosure for a rocker assembly provided for improved heat transfer from a cylinder head.

BRIEF DESCRIPTION OF THE INVENTION

The present invention overcomes the aforementioned drawbacks without adding significant costs. The present invention is directed to an air diverter coupled to a cylinder head of an internal combustion engine to directionally provide cooling air to multiple locations on the cylinder head.

In accordance with one aspect of the invention, an air diverter for an internal combustion engine includes a main diverter shield having a proximal end extending from a cooling source to a distal end and extending to the back of the internal combustion engine. A first arcuate member is attached to the main diverter shield between the proximal end and the distal end of the main diverter shield. A second arcuate member is connected to the main diverter shield near the distal end of the main diverter shield. The two arcuate members provide multiple cooling paths to the cylinder head.

In accordance with another aspect of the invention, an air cooled internal combustion engine includes a block having at least one cylinder, a cylinder head connected to the block and having a plurality of cooling fins arranged about a periphery of the cylinder head. An air diverter is constructed to direct air flow to at least two distinct areas of the cylinder head and is attached to the cylinder head.

In accordance with a further aspect of the invention, a cylinder head assembly for an internal combustion engine includes a cylinder head having a plurality of cooling fins extending around the periphery of the cylinder head, and an air diverter coupled to the cylinder head. The air diverter further includes a main body having a substantially linear section and a curvilinear section. The substantially linear section extends from a cooling source to the curvilinear section at a back end of the cylinder head. An arc-shaped member is coupled to the substantially linear section of the main body to provide cooling through a mid-section of the cylinder head.

Various other features and advantages will be made apparent from the following detailed description and the drawings.

BRIEF DESCRIPTION OF THE DRAWINGS

The drawings illustrate embodiments presently contemplated for carrying out the invention.

In the drawings.

DETAILED DESCRIPTION

Embodiments of the invention are directed to an intake port of a cylinder head of an air cooled internal combustion engine; a push rod tube configuration within the cylinder head of the air cooled combustion engine; and an air guide for directing cooling air to the cylinder head of the air cooled combustion engine. The various embodiments of the invention are incorporated into the air cooled internal combustion engine, which in turn is incorporated as a prime mover/prime power source in any of a number of various applications, including but not limited to, power generators, lawnmowers, power washers, recreational vehicles, and boats, as just some examples. While embodiments of the invention are described below, it is to be understood that such disclosure is not meant to be limiting but set forth examples of implementation of the inventions. The scope of the inventions is meant to encompass various embodiments and any suitable application in which a general purpose internal combustion engine can benefit from the inventions shown and described herein. It is understood that certain aspects of the inventions may equally be applicable to non-air cooled internal combustion engines as well and such is within the scope of the present inventions.

Figure 1:
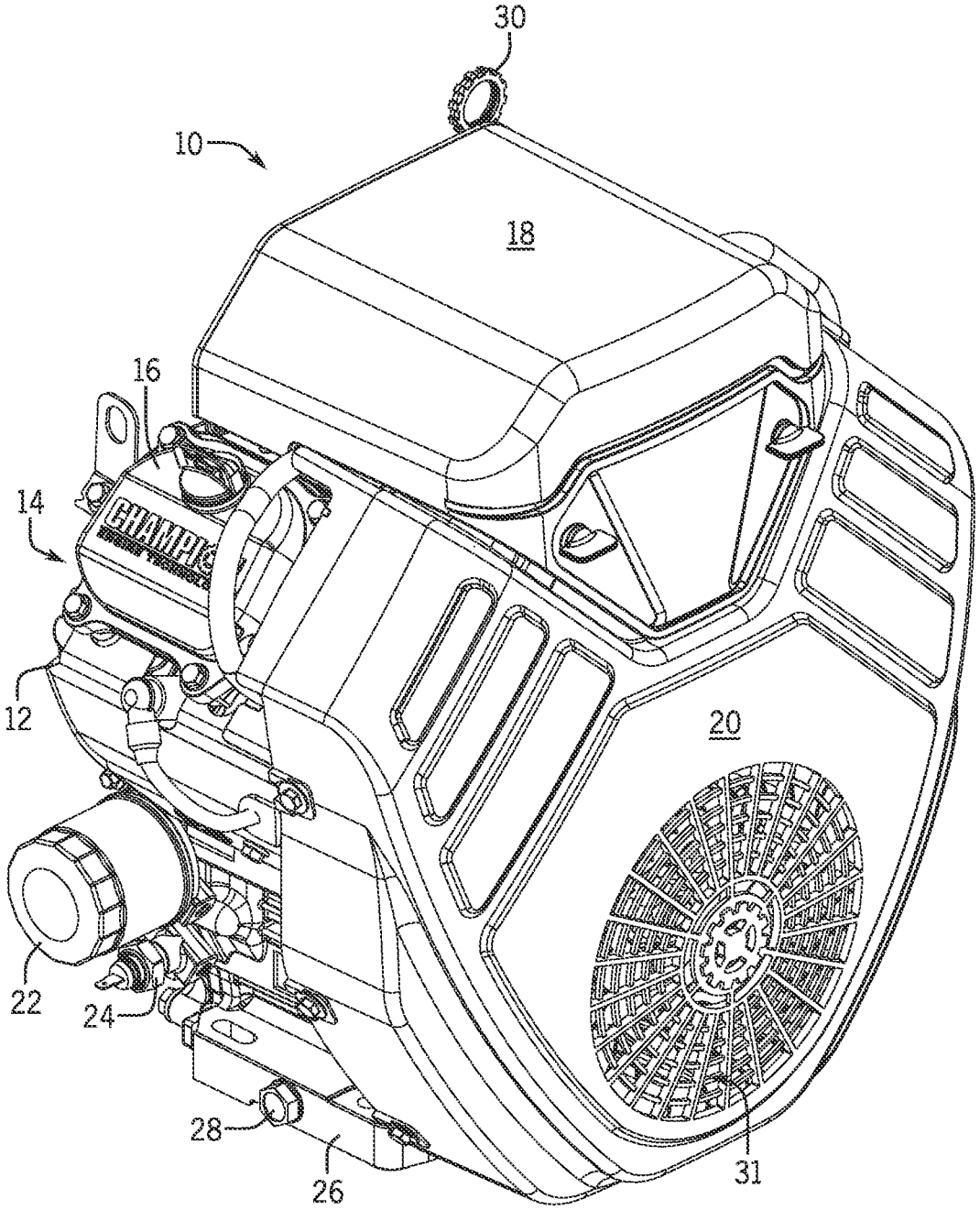
FIG. 1 is a perspective view of an internal combustion engine incorporating the present invention.

Referring first to FIG. 1, an internal combustion engine 10 is an exemplary V-twin having two combustion chambers and associated pistons (not shown) within an engine block 12 having a pair of cylinder heads 14 capped by rocker covers 16. The internal combustion engine 10 of FIG. 1 includes decorative and functional covers 18 and 20, as well as conventional oil filter 22, pressure sensor 24, oil pan 26, drain plug 28, and dip stick 30, together with the other conventional parts associated with an internal combustion engine. A cooling source 31 draws cooling air in toward internal combustion engine 10 through covers 20.

Figure 2:
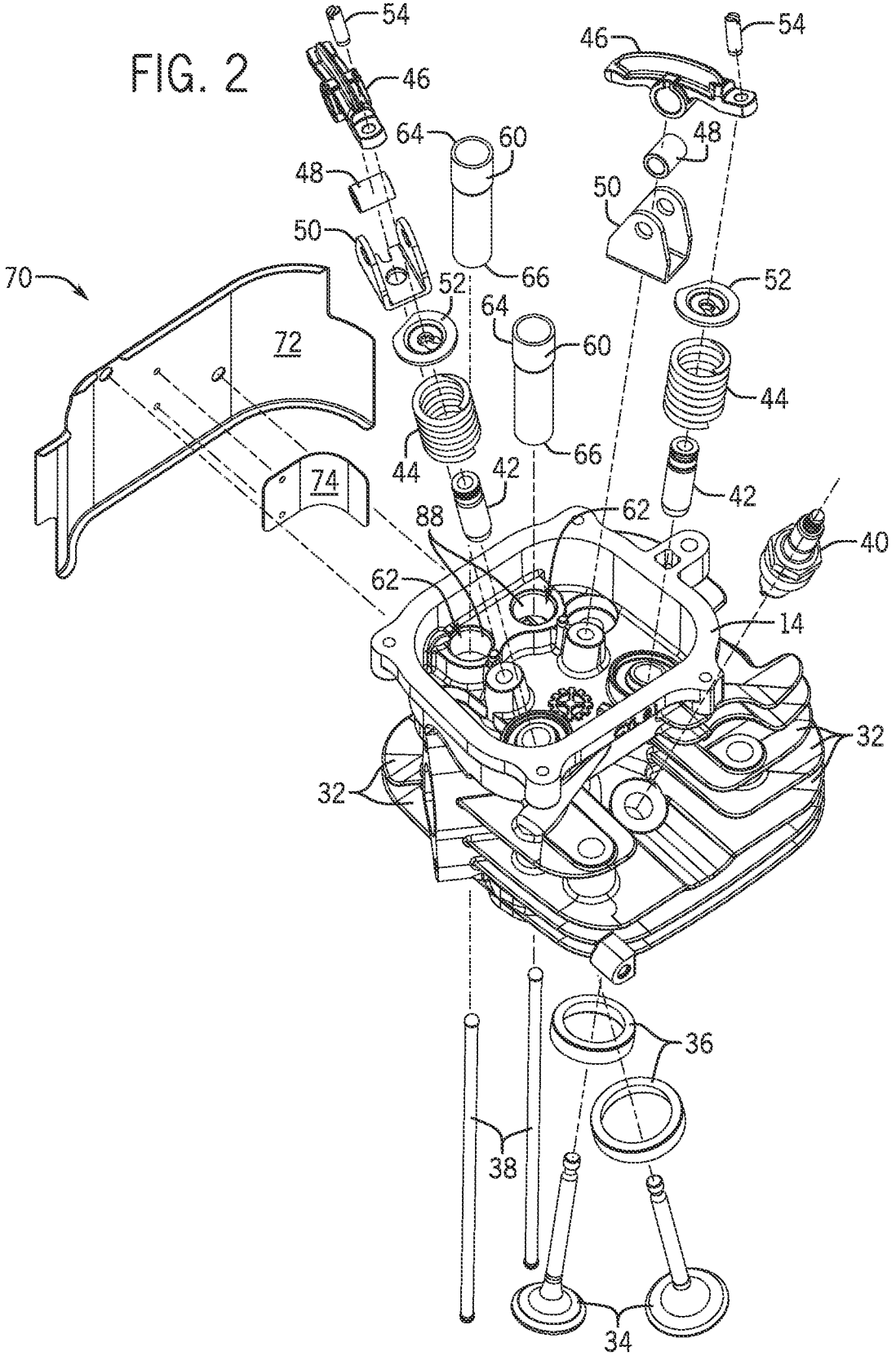
FIG. 2 is an exploded perspective view of a cylinder head of FIG. 1 incorporating the present invention.

FIG. 2 is an exploded view of cylinder head 14 having a plurality of cooling fins 32, intake and exhaust valves 34, valve seats 36, and push rods 38. Exploded from the upper portion of cylinder head 14 are spark plug 40, valve guides 42, valve springs 44, rocker arms 46, bushings 48, rocker arm supports 50, spring caps 52, and slack adjusters 54. All operational in a conventional manner.

Cylinder head 14 includes push rod tubes 60 that are pressed fit into respective bores 62 of cylinder head 14. Each push rod tube 60 has two outside diameters 64, 66 that are received into bore 62 of cylinder head 14 such that the smaller diameter 66 passes unobstructed through the bore 62 until the larger diameter 64 reaches the top of bore 62 to allow an even press-in fit. As is shown in further detail and will be described hereinafter with respect to FIGS. 9 and 10.

FIG. 2 also shows an air guide/diverter 70 having a main diverter shield 72 and a secondary air guide/diverter 74 attached thereto by fastening with anchors or welding. It is understood that the air guide/diverter 70 could be constructed as a single unitary structure or a multi-piece configuration having two or more pieces. The structure and function of the air diverter 70 will be further described with reference to FIGS. 11-14.

Figure 3:
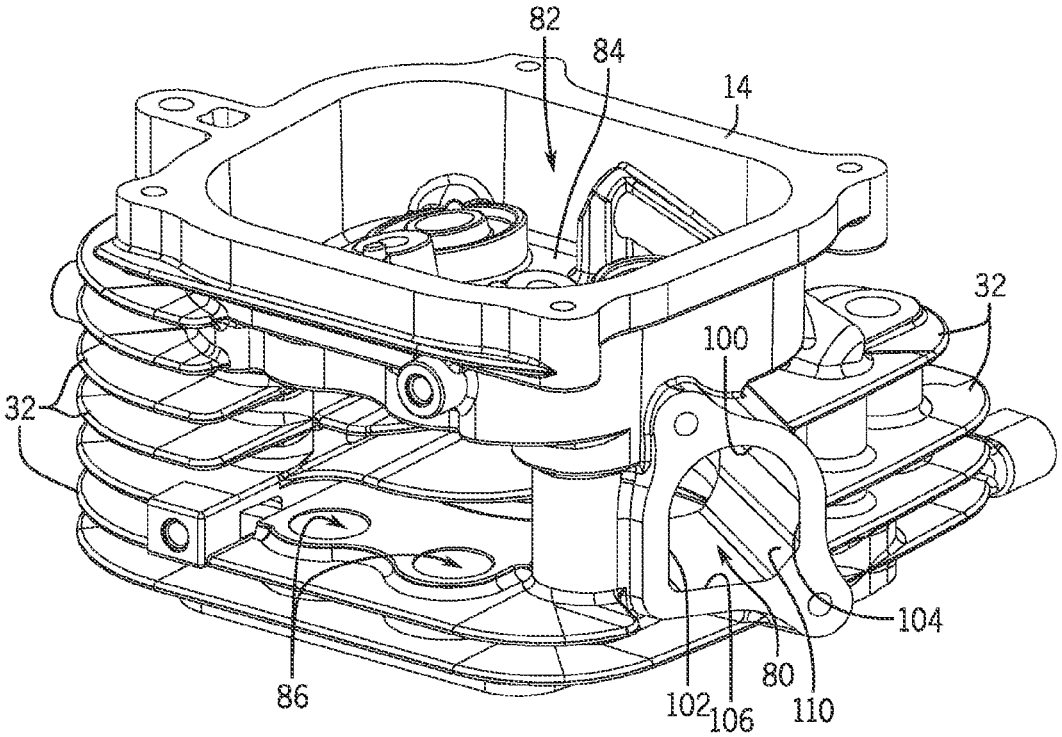
FIG. 3 is a side perspective view of the cylinder head of FIG. 2.
Figure 8:
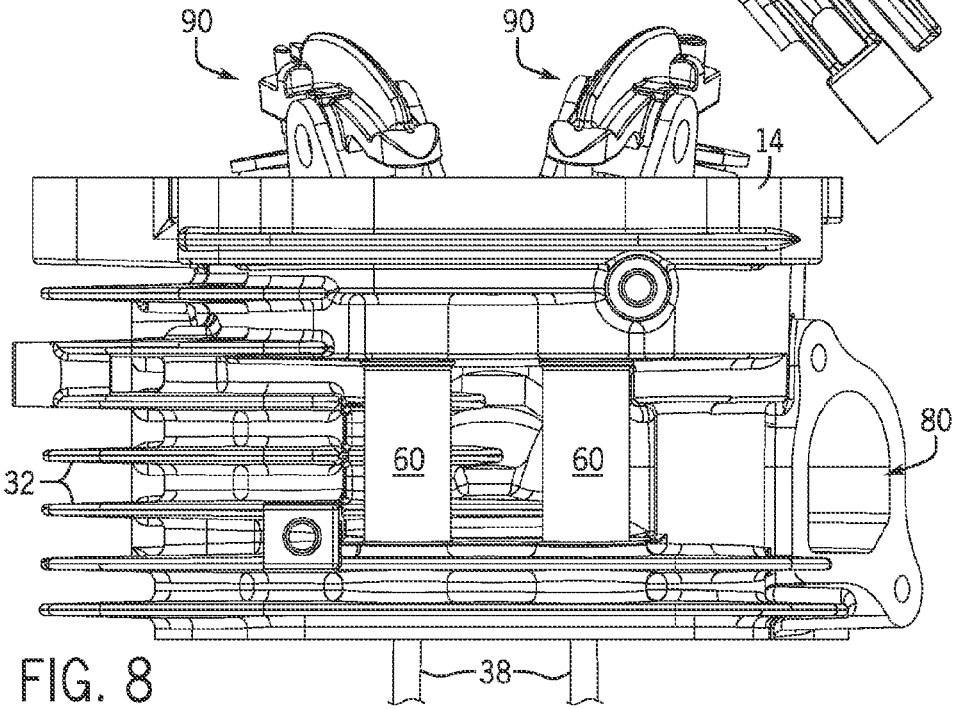
FIG. 8 is a side view of the cylinder head of FIG. 2 with rocker components assembled therein.

Referring next to FIG. 3, cylinder head 14 is shown with intake port 80 in the foreground. Cylinder head 14 has a recessed rocker cavity 82 having a lower surface 84 to accommodate at least a portion of the valve springs 44 and the rocker arm assembly 90, as best shown in FIG. 8. Cylinder head 14 is then capped with rocker covers 16, as shown in FIG. 1. Referring back to FIG. 3, lower push rod tube bores 86 are shown having a smaller diameter than the upper push rod bores 88 as shown in FIG. 2 to accommodate the efficient press fit of push rod tubes 60 therein. Accordingly, as one skilled in the art will now recognize, the push rod tubes are wholly contained within the cylinder head from the lower surface 84 of the rocker cavity 82 down through push rod tube bores 86 extending near the lower surface of cylinder head 14, as will be described with reference to FIG. 9.

Figure 4:
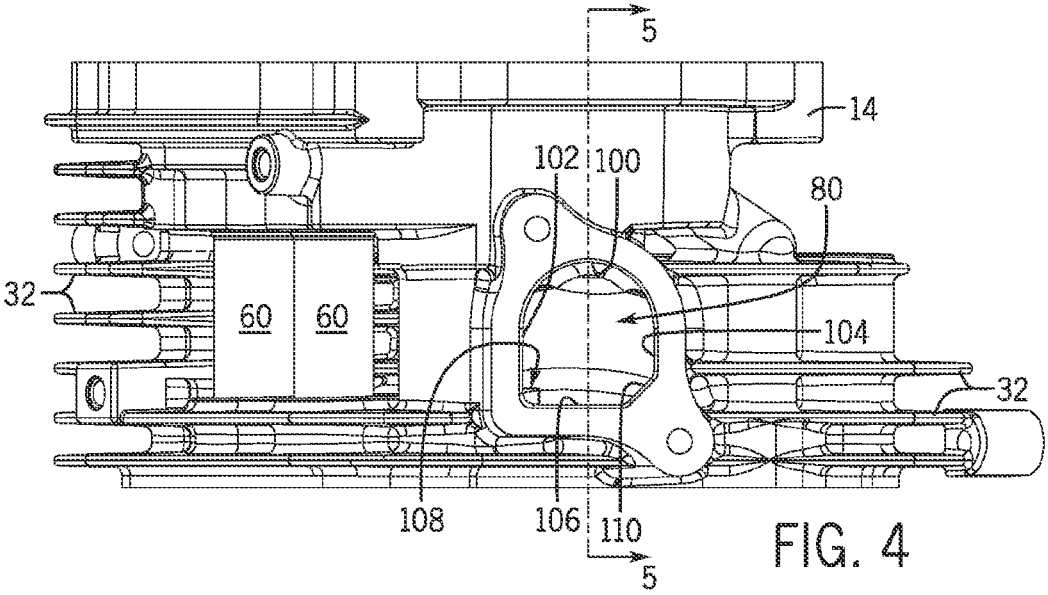
FIG. 4 is a side view of the cylinder head of FIG. 3.

Referring to both FIGS. 3 and 4, intake port 80 of cylinder head 14 is a modified D-shape that extends substantially evenly through cylinder head 14 toward the combustion chamber, other than the standard draft required for casting, which is typically and approximately 1°. The modified D-shape of intake port 80 comprises an arcuate surface 100 coupled to substantially flat side surfaces 102, 104 wherein flat side surface 102 extends a length greater than that of flat side surface 104. Flat side surface 106 is opposite arcuate surface 100 and is joined to flat side surface 102 by a generally right angle 108; however, it is understood that the inside corner of said right angle 108 may be formed by a gradual transition. Flat side surface 106 connects to flat side surface 104 via a flat, substantially planar, anti-puddling surface 110 in a general 45 degree angle, thereby cutting off, or eliminating, what would be the other 90 degree angle of a typical "D-shaped" configuration, thus forming the modified D-shaped configuration. The utility of the modified D-shaped configuration will be described with reference to FIG. 7.

Figure 5:
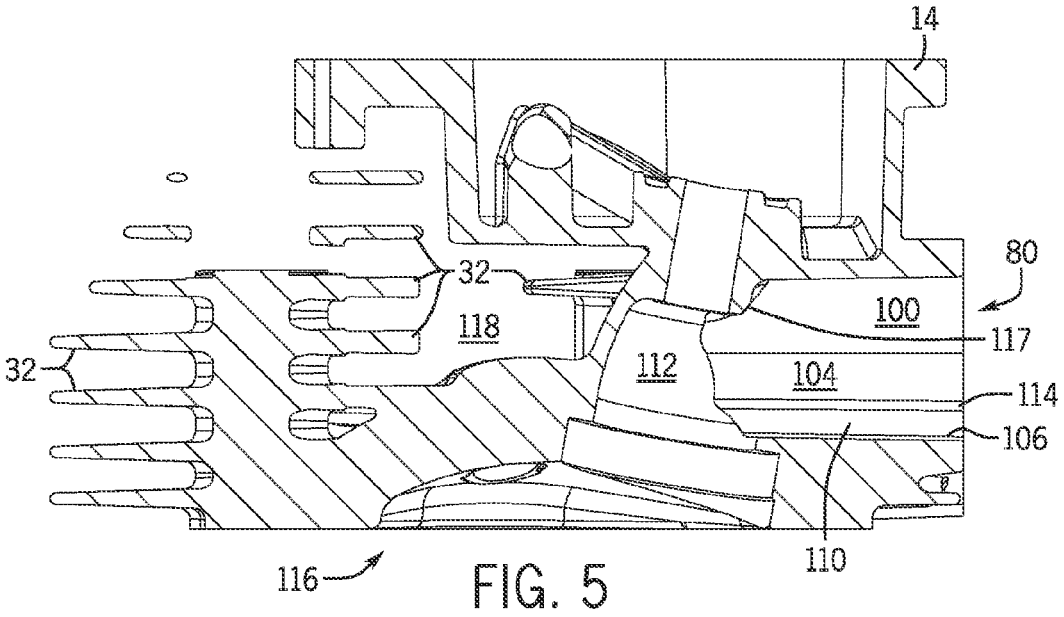
FIG. 5 is a cross-section view taken along line 5-5 of FIG. 4.

FIG. 5 is a cross-section taken along line 5-5 of FIG. 4 and shows intake port 80 of cylinder head 14 extending inward to intake valve passage 112. Intake port 80 is shown with the upper arcuate surface 100 connected to the flat side surface 104 connected to the anti-puddling surface 110 via a small transition surface 114. Intake valve passage 112 communicates with a combustion chamber 116. Intake port 80 extends substantially uniformly from an outer edge of cylinder head 14 to intersect with intake valve passage 112 and combustion chamber 116 at an inward transition region 117. The flat side surface 106 is substantially planar and its cross-section is perpendicular to a central axis of a cylinder bore and piston under the combustion chamber 116 or, in preferred embodiment, parallel to the bottom surface of the cylinder head. FIG. 5 also shows a cooling air pass-through 118 that provides additional cooling to cooling fins 32.

Figure 6:
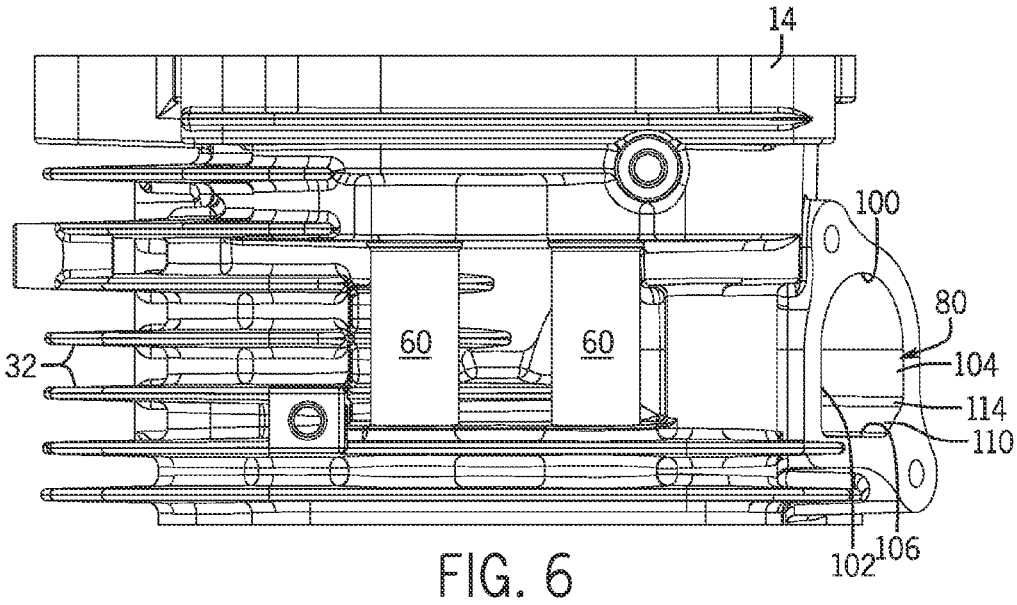
FIG. 6 is a side view of the cylinder head of FIG. 2.

Referring to FIG. 6, cylinder head 14 is shown in a side view having push rod tubes 60 inserted therein and shows another view of intake port 80 in perspective in which arcuate surface 100 connects to the substantially parallel flat side surfaces 102, 104, wherein flat side surface 104 connects to flat side surface 106 at a substantially right angle. The flat side surface 104 and the flat side surface 106 are connected by the flat, substantially planar, anti-puddling surface 110 via a transition surface 114.

Figure 7:
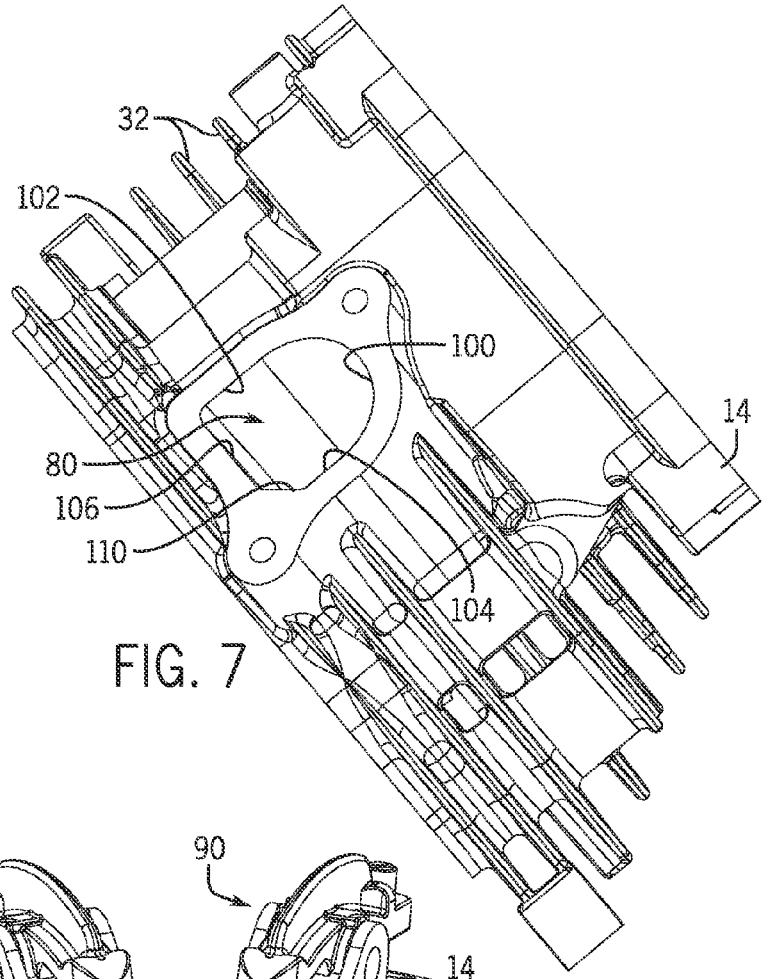
FIG. 7 is a side view of the cylinder head of FIG. 2 rotated in an exemplary orientation as implemented in the engine of FIG. 1.

FIG. 7 shows cylinder head 14 and intake port 80 orientated as installed on internal combustion engine 10 as shown in FIG. 1 in a horizontal crankshaft configuration such that the flat, substantially planar, anti-puddling surface 110 is substantially horizontal. In this configuration, the flat, anti-puddling surface 110 provides more surface area for unburned fuel to dissipate and prevent what is known in the industry as "puddling." As is known, "puddling" of fuel in a liquid form can cause a pop or backfiring on re-ignition. The anti-puddling surface 110, in the horizontal crankshaft orientation, reduces the occurrence of such puddling in a properly tuned engine. The aforementioned internal combustion engine 10 of FIG. 1 is also constructed to operate in a vertical crankshaft position wherein flat side surface 102 is substantially parallel with the horizon and thus becomes the anti-puddling surface. Alternatively, one skilled in the art will now readily recognize that the other surfaces could be used in conjunction with one another to provide at least two anti-puddling surfaces in engine configuration orientations rotated in approximately 45 degree increments. Such configuration provides for a wide implementation of an engine incorporating the present invention. This increased surface area on the horizontal surface allows for the spreading out of fuel over a wider surface to promote higher evaporation rates, which in turn improves atomization to improve the combustion process, and results in reduced misfires and improves the consistency of the exhaust emissions. Additionally, the reduction and/or elimination of fuel puddling that is provided by the present invention also reduces any periodic over-rich combustion that typically results in black exhaust emission.

FIG. 8 shows cylinder head 14 assembled with rocker arm assemblies 90 mounted thereon and push rods 38 extending upward to the rocker arm assemblies 90 through push rod tubes 60. Intake port 80 is shown in a side perspective view. As previously mentioned, rocker covers 16 of FIG. 1 is attached over cylinder head 14 to enclose rocker arm assemblies 90.

Figure 9:
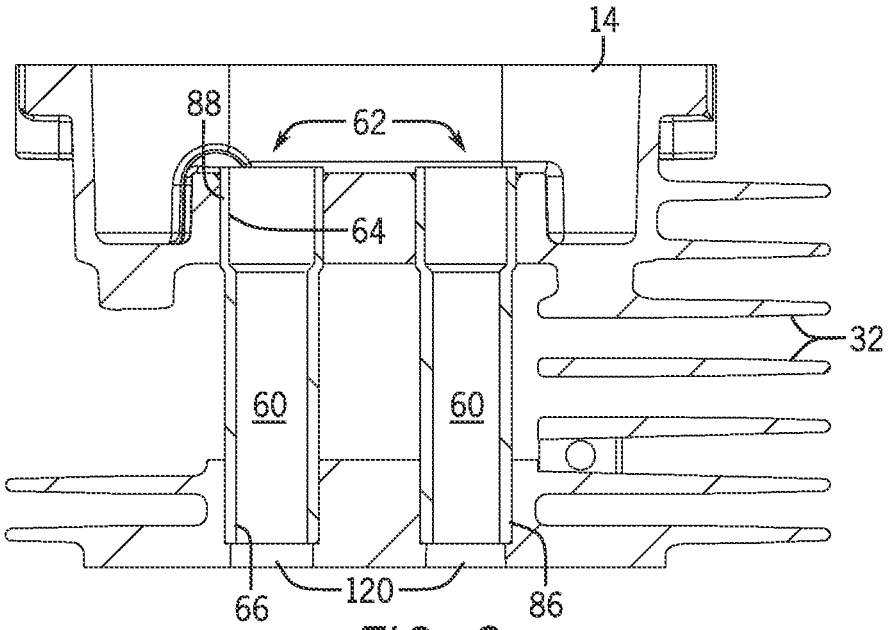
FIG. 9 is a sectional view of the cylinder head of FIG. 2 showing push rod tube holders in cross section.

Referring now to FIG. 9, cylinder head 14 is shown in cross section through push rod tubes 60. Push rod tubes 60 have a smaller diameter 66 on a lower end and a larger diameter 64 at an upper end. With the cylinder head 14 having a larger bore 88 at the upper end and a smaller bore 86 at the lower end to allow for push rod tubes 60 to be dropped into the passage bores 62 until resistance is met whereby the push rod tubes 60 are then pressed into place against boss stops 120. The boss stops provide affirmative seating of the push rod tubes 60 into cylinder head 14.

Figure 10:
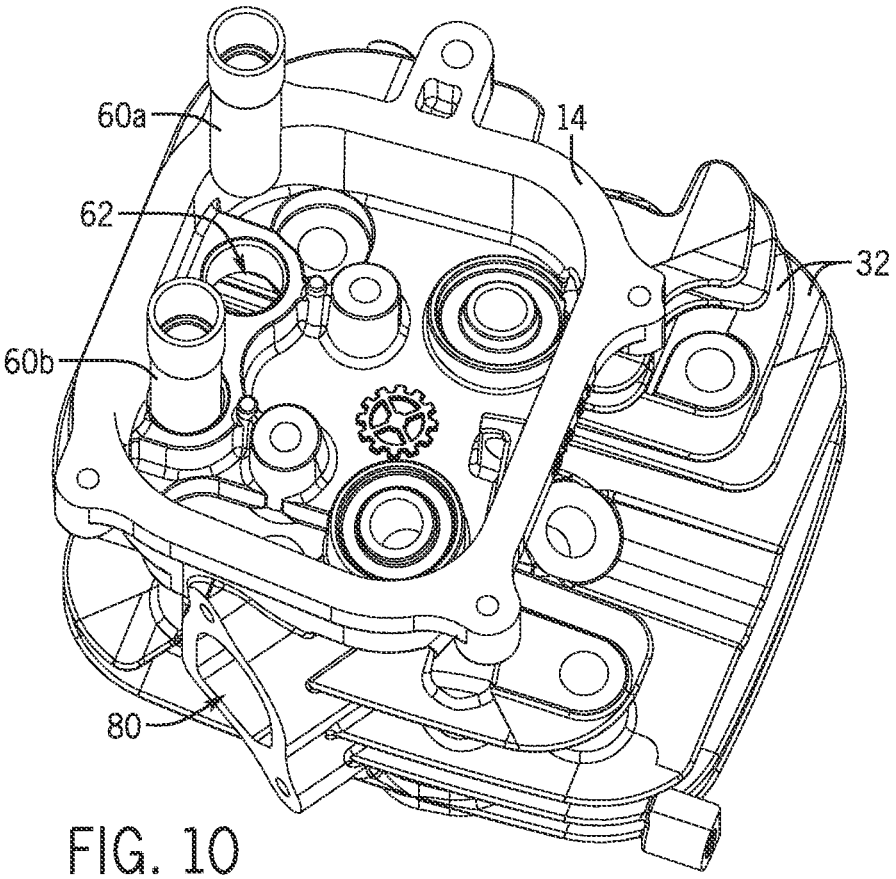
FIG. 10 is a top perspective view of the cylinder head of FIG. 2.

Referring to FIG. 10, cylinder head 14 is shown in perspective from a top side view with push rod tube 60(*a*) above push rod tube passage bores 62, and push rod tube 60(*b*) partially inserted into its respective passage to then be pressed firmly into place. The modified D-shaped intake port 80 is shown from the top side view perspective.

Figure 11:
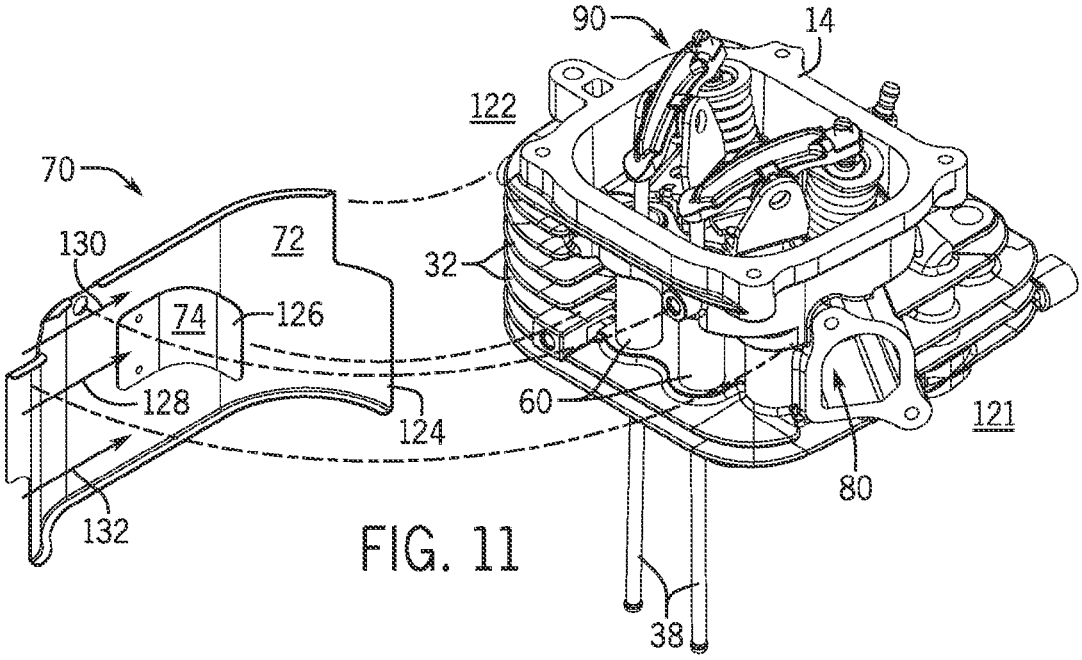
FIG. 11 is a perspective view showing an assembled cylinder head of FIG. 2 with an air guide rotated away therefrom.

FIG. 11 shows cylinder head 14 in an assembled configuration with rocker arm assemblies 90 installed therein and push rods 38 extending therefrom. Air diverter 70 is shown rotated away from cylinder head 14 where it is secured thereto. Air diverter 70 includes a main diverter shield 72 which extends from a cooling source at a front side 121 of the engine to a back side 122 of the engine. A cooling source 31, of FIG. 1, draws air inward through engine cover 20 and air diverter 70 directs some of that cooling air into and across at least two distinct areas of cylinder head 14. Main diverter shield 72 has a first arcuate member 124 to direct cooling air over and across cooling fins 32 at a back side 122 of cylinder head 14. The second arcuate member 126 directs air to and across push rod tubes 60 and cooling fins 32 behind the push rod tubes 60. The air flow is constructively divided into three paths, an internal air path shown by arrow 128 and directed by the secondary air guide/diverter 74 and second arcuate member 126, and rear air flow path 130,132 being directed by main diverter shield 72 and first arcuate member 124.

Figure 12:
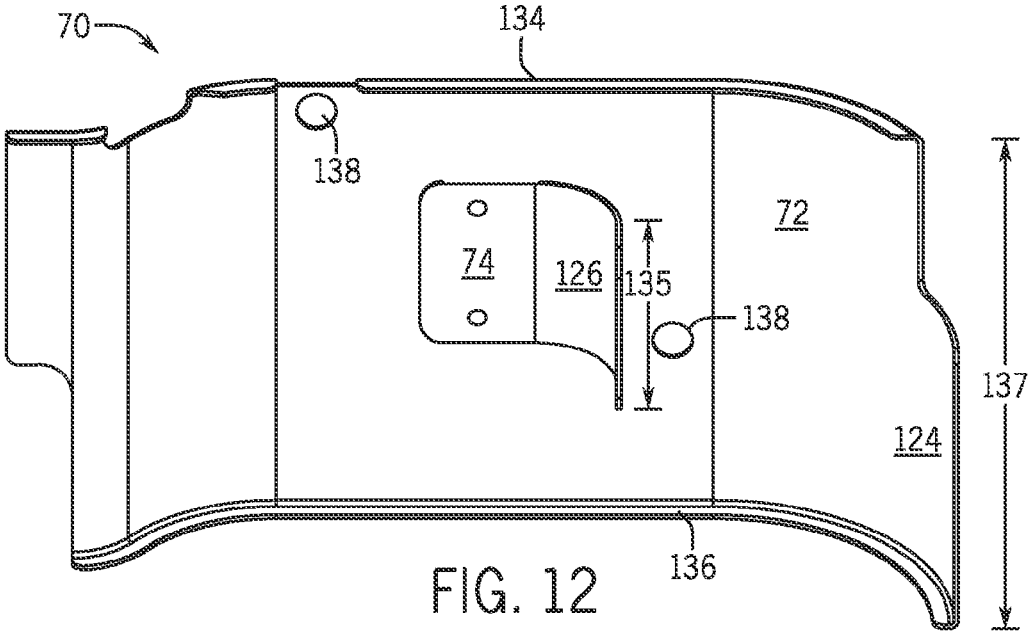
FIG. 12 is a side view of the air guide of FIG. 11.

Referring to FIG. 12, these air flow channels are formed by the second arcuate member 126 having a width 135 less than the width 137 of the first arcuate member 124. Air guide 70 is constructed with upper and lower lips 134, 136 to assist in retaining air flow within air guide 70. Openings 138 allow for fasteners to pass therethrough and fasten air guide 70 to cylinder head 14.

Figure 13:
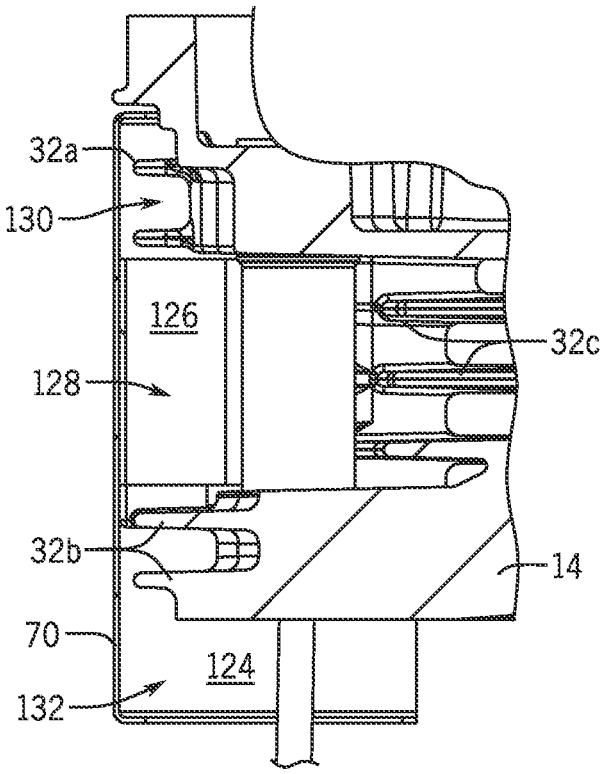
FIG. 13 is a partial sectional view of the cylinder head and air guide of FIG. 11.

FIG. 13 is a section view showing the multiple air path/channels 128, 130, 132. Air flow path 130 directs cooling air across cooling fins 32(*a*), while air flow path 132 directs air across cooling fins 32(*b*). The internal air flow path 128 directs air across cooling fins 32(*c*) located centrally and internally within cylinder head 14.

Figure 14:
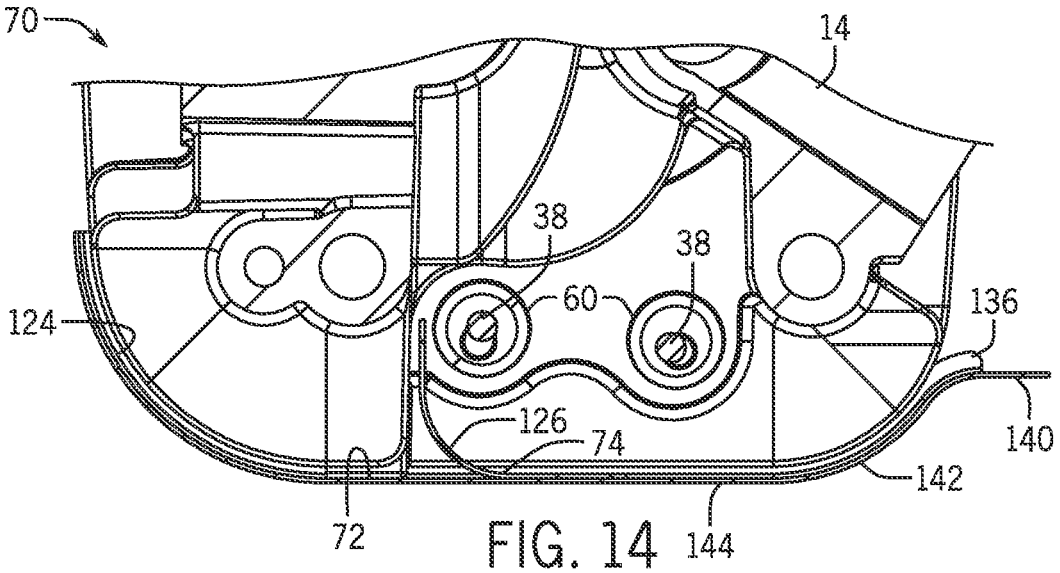
FIG. 14 is a partial top view of the cylinder head and air guide configuration of FIG. 11.

Referring to FIG. 14, is a top section view showing air diverter 70 from a top view installed on cylinder head 14. Air guide 70 includes a first planar section 140 extending frontward to receive air flow therein connected to transition section 142 leading to longitudinally planar section 144 and terminating at the first and second arcuate members 124, 126. FIG. 14 also shows push rod tubes 60 installed in cylinder head 14 with push rods 38 extending therethrough.

Figure 15:
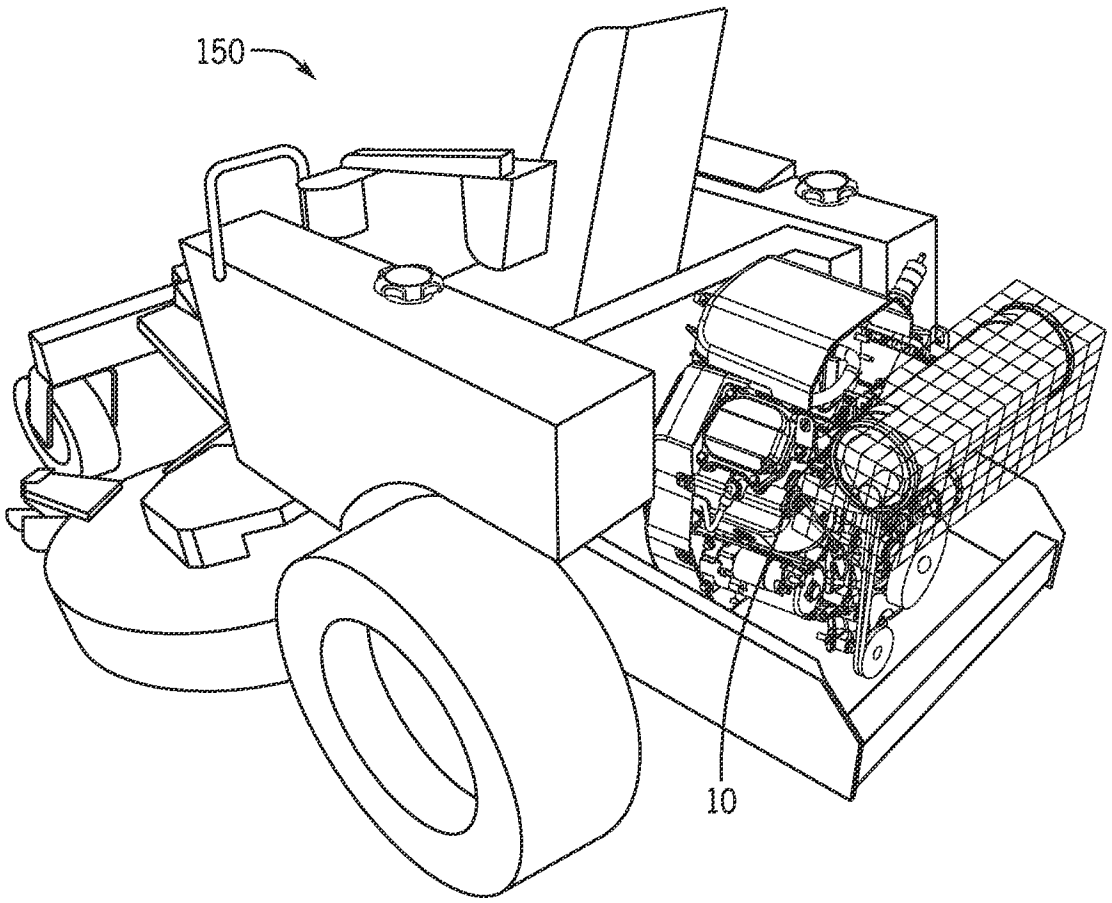
FIG. 15 is a perspective view of a wheel driven vehicle incorporating the present invention.

FIG. 15 shows an example of a wheel driven vehicle 150 powered by internal combustion engine 10 incorporating the present inventions. In this case, the wheel driven vehicle is a lawnmower, but could equally be any wheel driven vehicle.

Figure 16:
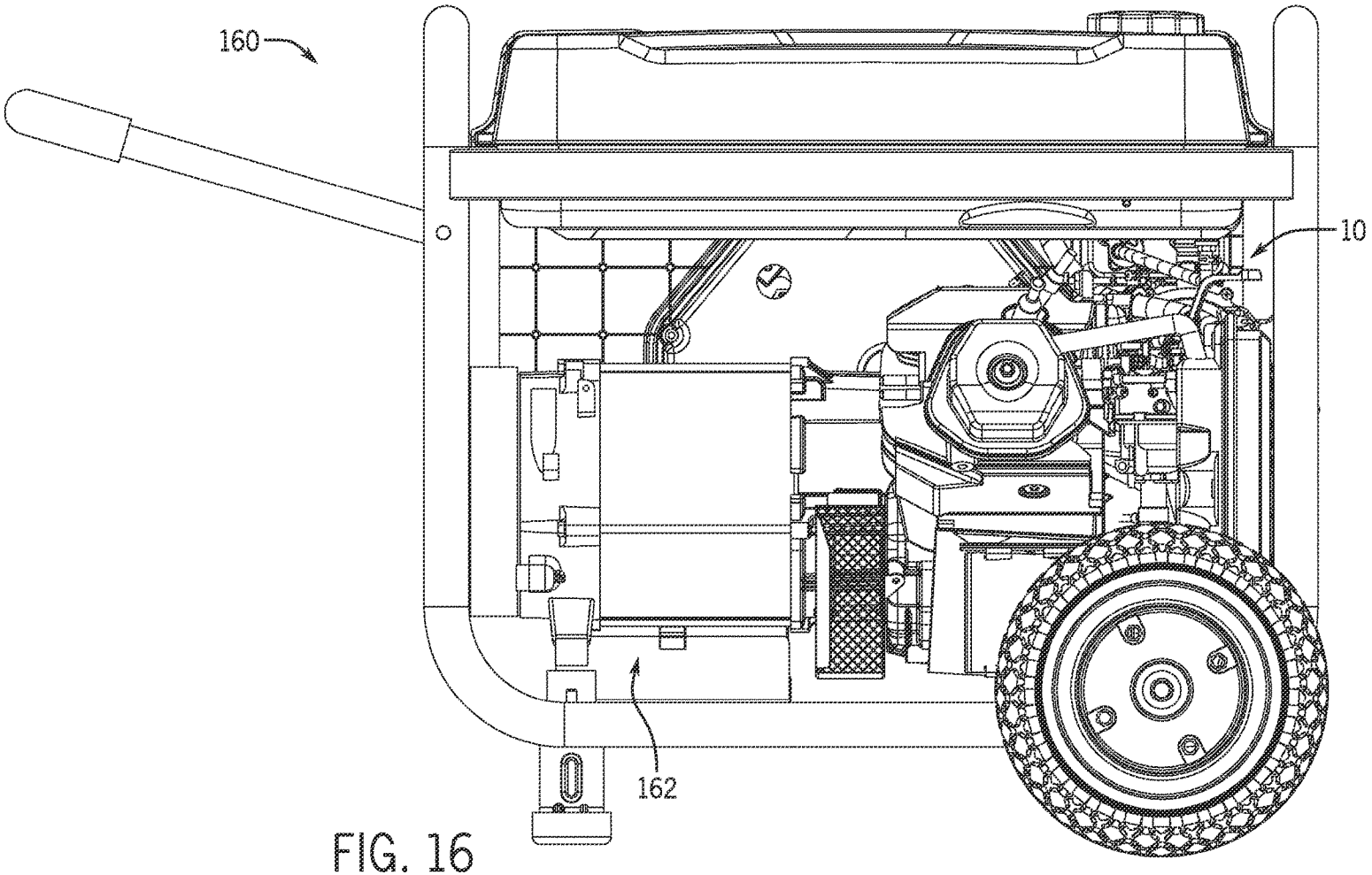
FIG. 16 is an exemplary non-wheel driven apparatus incorporating the present invention.

FIG. 16 shows a non-wheel driven apparatus 160, in this case a portable generator. The portable generator includes internal combustion engine 10 driving a generator unit 162 and is just one example of a non-wheel driven apparatus benefiting from the inventions described herein.

Therefore, according to one embodiment of the invention, an air diverter for an internal combustion engine includes a main diverter shield having a proximal end extending from a cooling source to a distal end extending to a back end of the internal combustion engine, a first arcuate member attached to the main diverter shield between the proximal end and the distal end of the main diverter shield, and a second arcuate member connected to the main diverter shield near the distal end of the main diverter shield.

According to another embodiment of the invention, an air cooled internal combustion engine includes a block having at least one cylinder, a cylinder head connected to the block and having a plurality of cooling fins arranged about a periphery of the cylinder head, and an air diverter attached to the cylinder head and constructed to direct air flow to at least two distinct areas of the cylinder head.

According to yet another embodiment of the invention, a cylinder head assembly for an internal combustion engine includes a cylinder head having a plurality of cooling fins extending around the periphery of the cylinder head, and an air diverter coupled to the cylinder head. The air diverter further includes a main body having a substantially linear section and a curvilinear section, the substantially linear section extending from a cooling source and the curvilinear section at a back end of the cylinder head, and an arc-shaped member coupled to the substantially linear section of the main body.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An air diverter for an internal combustion engine comprising:

a main diverter shield having a proximal end extending from a cooling source to a distal end extending to a back end of the internal combustion engine;

a first arcuate member attached to the main diverter shield between the proximal end and the distal end of the main diverter shield having an arc extending perpendicular to the main diverter shield toward an interior of the internal combustion engine; and a second arcuate member connected to the main diverter shield near the distal end of the main diverter shield.

2. The air diverter of claim 1 wherein the air diverter is attached to a single cylinder of a multi-cylinder engine.

3. The air diverter of claim 1 wherein the first arcuate member has a width less than that of the second arcuate member.

4. The air diverter of claim 1 wherein the first arcuate member directs airflow generally to a center of a cylinder head.

5. The air diverter of claim 4 wherein the airflow is directed across push rod tubes enclosing push rods of the internal combustion engine.

6. The air diverter of claim 5 wherein the push rod tubes extend entirely within a cylinder head of the internal combustion engine.

7. The air diverter of claim 1 wherein the second arcuate member directs airflow across rear air cooling fins of a cylinder head of the internal combustion engine.

8. The air diverter of claim 1 wherein the second arcuate member is constructed integrally with the main diverter shield.

9. The air diverter of claim 1 wherein the first arcuate member is an independent member and fastened to the main diverter shield and the main diverter shield is fastened to a cylinder head of the internal combustion engine with at least one fastener.

10. The air diverter of claim 1 wherein the first arcuate member is arranged on the air diverter to form three air flow paths, a first and third air flow path directs air to the second arcuate member and a second air flow path directs air toward a centralized area of a cylinder head of the internal combustion engine.

11. An air cooled internal combustion engine comprising:

a block having at least one cylinder;

a cylinder head connected to the block and having a plurality of cooling fins arranged about a periphery of the cylinder head; and an air diverter attached to the cylinder head and comprising first and second arcuate members constructed to direct air flow to separate areas of the cylinder head; and wherein the first arcuate member is arranged on the air diverter to form three air flow paths; and wherein a first and third air flow path directs air to the second arcuate member and a second air flow path directs air toward a centralized area of the cylinder head.

12. The air cooled internal combustion engine of claim 11 wherein the air diverter has first and second air diversion channels, the first air diversion channel arranged to divert cooling air toward a center of the cylinder head and the second air diversion channel arranged to direct air to rear cooling fins of the cylinder head.

13. The air cooled internal combustion engine of claim 11 wherein the first arcuate member has a width less than that of the second arcuate member.

14. The air cooled internal combustion engine of claim 11 incorporated in a wheel driven vehicle.

15. The air cooled internal combustion engine of claim 11 incorporated in a non-wheel driven apparatus.

* * * * *